United States Patent [19]

Prodel

[11] 4,181,236

[45] Jan. 1, 1980

[54] COLLAPSIBLE AND STACKABLE PLASTIC TRANSPORT CASE

[76] Inventor: Ulrich H. Prodel, Grunstrasse 13, D-4902 Bad Salzuflen, Fed. Rep. of Germany

[21] Appl. No.: 833,998

[22] Filed: Sep. 16, 1977

[30] Foreign Application Priority Data

Aug. 23, 1977 [DE] Fed. Rep. of Germany ..... 2737867

[51] Int. Cl.[2] ..... B65D 7/24; B65D 7/00

[52] U.S. Cl. ..... 220/6; 220/7; 220/4 F

[58] Field of Search ..... 220/6, 7, 1.5, 4 F; 150/0.5; 217/14, 15, 16, 46, 47, 48

[56] References Cited

U.S. PATENT DOCUMENTS

| | | | |
|---|---|---|---|
| 3,254,786 | 6/1966 | Melville | 220/6 |
| 3,870,185 | 3/1975 | Sanders et al. | 220/6 |
| 3,941,271 | 3/1976 | Zarges et al. | 220/6 |
| 4,044,910 | 8/1977 | Box | 220/6 X |
| 4,081,099 | 3/1978 | Shead | 220/6 |

*Primary Examiner*—Steven M. Pollard
*Attorney, Agent, or Firm*—Robert E. Burns; Emmanuel J. Lobato; Bruce L. Adams

[57] ABSTRACT

A collapsible and stackable plastic transport case comprises first and second pairs of like side walls hingedly connected together and a bottom and cover each hingedly connected to the lower and upper edges respectively of one of the side walls. Each side wall of the first pair has one vertical edge hingedly connected with the adjacent vertical edge of the respective side wall of the second pair while at the other vertical edge it is provided with connecting portions which project inwardly a distance corresponding to the combined thickness of the side wall and the bottom are hingedly connected to the respective side wall of the second pair at a distance from the vertical edge corresponding to the projection of the connecting portions. The hinged connections comprise pivot pins on one member and U-shaped bearing eyes on the other member which snap over the pivot pins in assembling the case.

7 Claims, 13 Drawing Figures

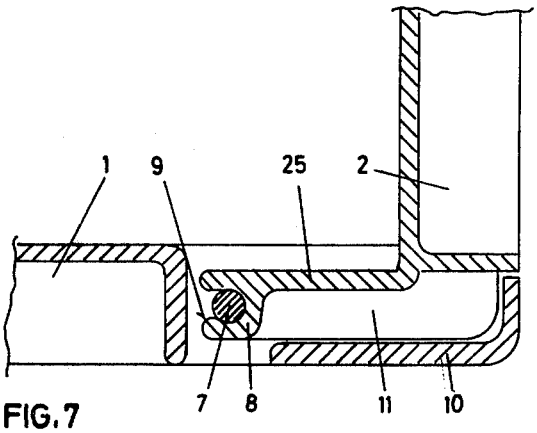
FIG. 7
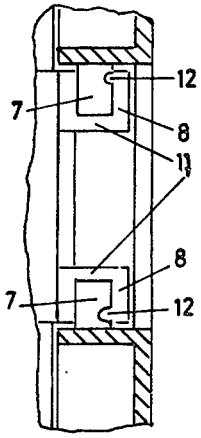
FIG. 10
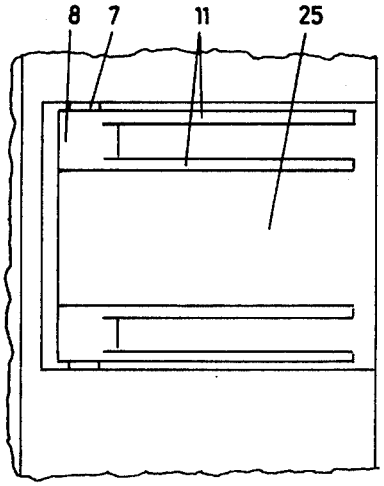
FIG. 8
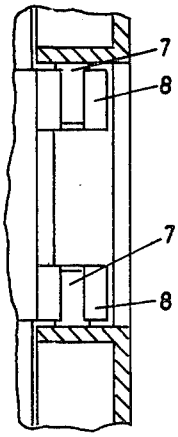
FIG. 9
FIG. 11
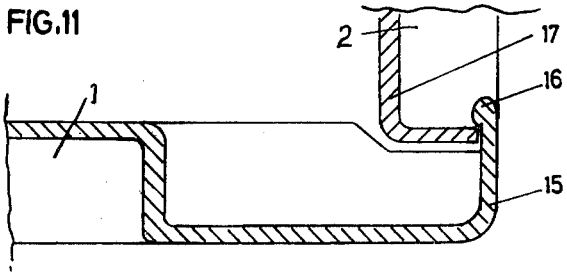

COLLAPSIBLE AND STACKABLE PLASTIC TRANSPORT CASE

FIELD OF INVENTION

The present invention relates to plastic transport cases and in particular to transport cases which are collapsible so that they can be folded to a compact form when empty and which are stackable both when they are empty and when they are full.

BACKGROUND OF THE INVENTION

Many kinds of merchandise are presently shipped in corrugated cartons which are thrown away when empty. This practice is ecologically unsound in that it represents a waste of material and also presents a disposal problem.

These disadvantages are avoided by the use of permanent shipping cases which are repeatedly reused. However, the storage of such cases when empty and the return of them to the shipper for reuse present problems and increase the cost of storage and shipping.

In an effort to reduce storage and shipping costs, it has been proposed to use collapsible shipping cases which can be folded, collapsed or knocked down when empty so as to reduce their size. However, collapsible transport cases heretofore available have lacked durability and have been inconvenient to maufacture and to use.

SUMMARY OF THE INVENTION

It is an object of the invention to overcome the disadvantages of prior transport cases by providing a collapsible and stackable plastic transport case which can be economically manufactured and is durable and convenient in use.

In accordance with the invention a collapsible and stackable plastic transport case comprises two pairs of like side walls which are connected together by rows of hinges along their side edges and a bottom which is hingedly connected to the lower edge of one of the side walls and is foldable against the inner face of this side wall. Each of the side walls of one of the pairs has one side edge hingedly connected with the adjacent side edge of a respective side wall of the other pair while at the opposite side edge there are connecting portions which project inwardly a distance corresponding to the combined thickness of the side wall and the thickness of the bottom so that when the case is collapsed the side walls are parallel with one another and the bottom is disposed between the side walls. The connecting portions are hingedly connected with the respective side walls of the other pair at a distance from the side edges thereof corresponding to the projection of the connecting portions so as to provide overhanging edge portions which extend beyond the hinge connection and cover the connecting portions and the adjacent edge of the other side wall.

The invention is directed to the problem of providing such a collapsible plastic transport case with robust hinges which are easily produced and are simple to assemble whereby assembly of the case is greatly facilitated.

In accordance with the invention the hinges comprise, for example, two opposed pivot pins and two U-form bearing eyes which partially surround the pivot pins. The opposite legs of the U-shaped bearing eyes are perpendicular to the plane of the side wall on which they are provided. In this manner there is provided a hinge that is easily produced of plastic since the die or mold for producing the side walls of the transport case does not require any special provisions such as slides or the like. Moreover, these hinges are extremely robust and do not break even under high load. They are also easy to assemble. For the assembly of adjacent side walls of the case it is merely necessary to lay the side walls one on the other and then press the side walls together so that the U-shaped bearing eyes snap over the pivot pins. This can be done for example by a blow of a rubber hammer or by a press. Thus no special equipment is required as the side walls lie parallel to one another as in the folded or collapsed state of the case.

Suitably the hinges are integral with the side walls so that they are produced during the production of the side walls for example through injection molding in such manner that the legs of the U-shaped bearing eyes are mounted on a plate portion of the respective side wall which is reenforced at least at its edge by ribs.

The ruggedness of the hinge is increased by the fact that the ribs on the edge of the plate merge with and are integral with both legs of the U-shaped bearing eyes.

It is advantageous when at least one leg of the U-shaped bearing eye is provided with a bead or cam portion so that the hinge cannot easily become disengaged.

The case may also be provided with a cover which is hingedly connected with the upper edge of one of the side walls and is swingable to a postion in which it lies against the outer face of such side wall. Moreover, the cover may be provided with openings to receive centering elements which prevent the cases from sliding relative to one another when a number of the collapsed cases are stacked.

BRIEF DESCRIPTION OF DRAWINGS

The nature, objects and advantages of the invention will be more fully understood from the following description in conjunction with the accompanying drawings which schematically illustrate an embodiment of a transport case in accordance with the invention. In the drawings:

FIG. 7 is a cross section through a hinge, FIG. 8 is a side view of the hinge, FIG. 9 is a side view of the hinge looking in the direction of the side wall, FIG. 10 is a view similar to FIG. 9 but showing a modified hinge construction, FIG. 11 is a section showing a snap lock arranged between two hinges.

DESCRIPTION OF PREFERRED EMBODIMENT

Figure 1:
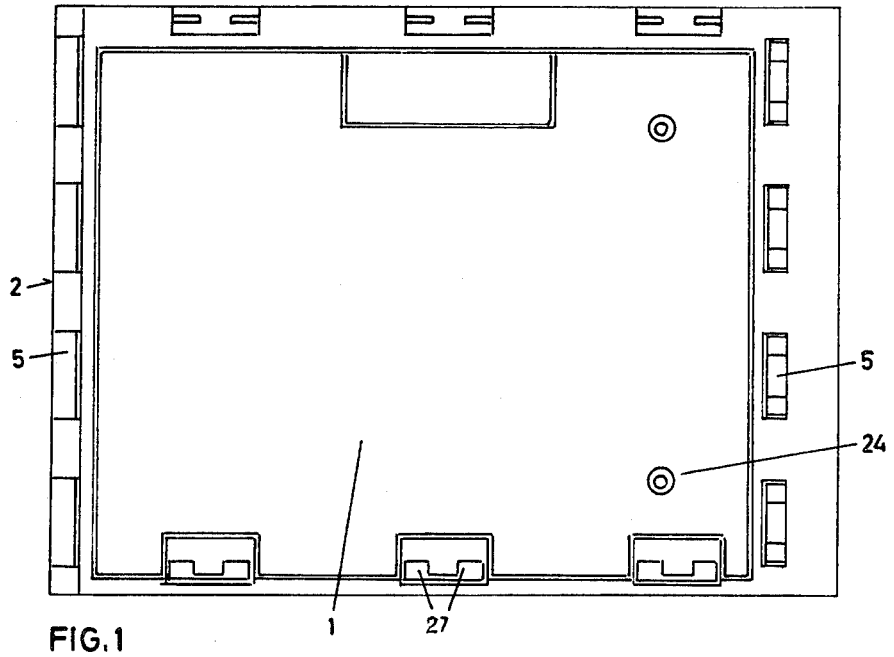
FIG. 1 is a side elevation of the long side of transport case in accordance with the invention.
Figure 2:
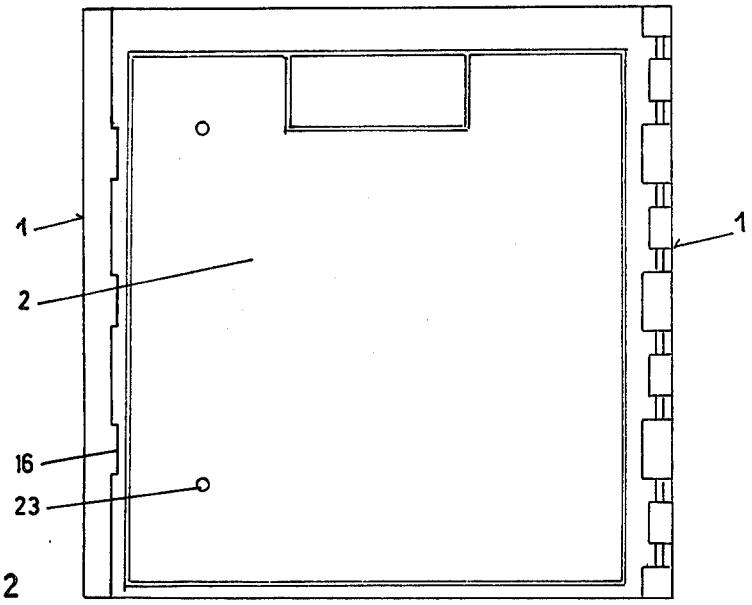
FIG. 2 is a side elevation of the short side of the transport case.
Figure 3:
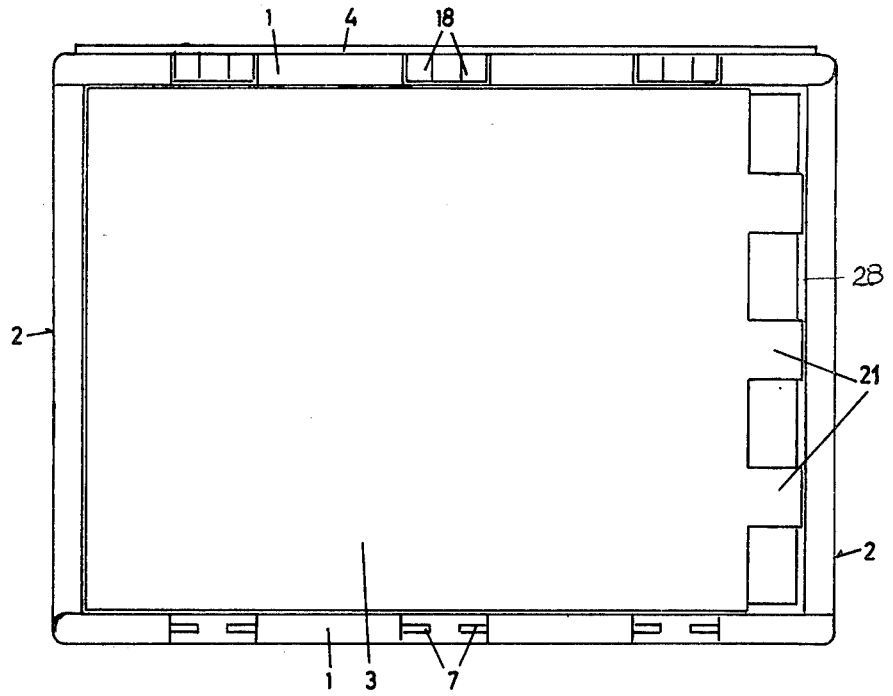
FIG. 3 is a plan view with the cover open.

The collapsible and stackable transport case shown by way of example in the drawings comprises a first pair of side walls 1, a second pair of side walls 2, a bottom 3, and a cover 4. Each side wall 1, each side wall 2, the bottom 3 and the cover 4 is a one piece injection molded part including necessary ribs, reenforcement, hinge parts, etc. As each of these parts is only a flat part consisting essentially of a plate provided with ribs, it can be produced with simple molds or dies on a simple injection molding machine. The connection of these individual parts of the transport case with one another is accomplished by the hinges. These hinges are so formed that they serve not only as hinges but at the same time as parts which snap together for the assembly of the side walls, bottom and cover with one another.

Figure 6:
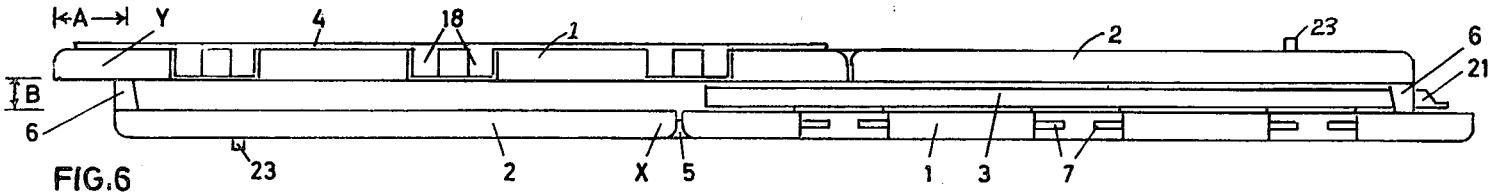
FIG. 6 is a plan view of the collapsed transport case.

Through the folding of the bottom 3 against the inner face of the side wall 1 on the lower edge of which it is hinged and through the folding of the side walls 1 and adjacent side walls 2 into a common plane, it is possible to collapse the case when empty to a flat condition as shown in FIG. 6 for storage and transport. In order that a pair of side walls 1,2 lying in a plane to be exactly parallel to the opposite pair, the side walls 2 are provided at one side edge with connecting portions 6 which project inwardly from the side wall and are connected by hinges 5 to the adjacent side wall 1. These hinge connections lie at a distance A from the edges of the side walls 1. The length of the projecting portions 6 is selected so that the distance B of the inner sides of the side walls 1 and 2 from one another in the folded or collapsed condition of the case is somewhat greater than the thickness of the bottom 3. The distances A and B are interrelated in that the distance A is given by the distance B together with the distance of the geometric axis of the hinge 5 from the inner face of the side wall 1. While one side edge of the side wall 2 is connected directly to the adjacent edge of the side wall 1 at place X, the connecting portions 6 at the other edge of the side wall 2 are connected with the other side wall 1 at location Y at a distance A from the edge of the side wall 1. The side wall 1 is thus constructed so that at one side the hinge lies on the edge while at the other side the hinge is arranged at a distance A from the edge which depends on the length of the projecting portions 6. There is thus provided an overhanging portion which overlies and covers the projecting portions 6 and the adjacent edge of the side wall 2 when the case is erected or set up.

The stability and carrying capacity of the transport case is determined by the material and the arrangement of the hinges. For the arrangement and construction of the hinges, it is essential that the assembly of the case is not difficult. For convenience of assembly of the case, the hinges must be formed as snap hinges but at the same time must be formed so that the hinge connections cannot easily come apart. Hence, these hinge connections must have a very high stability and moreover in order for the cases to be stackable one on the other it is necessary for the corners, where the hinges are located, to be especially stable because in transport cases made of plastic it is the corners that must take the load as the corners have a higher stability than the side walls which can easily bow out under the load imposed by the superposed stacked cases.

In accordance with the invention as shown in more detail in FIGS. 7, 8 and 9, the individual hinges comprise two opposed hinge pins 7 on the side wall 1 which are received in U-shaped bearing eyes 8 provided at the inner edge of a plate portion 25 which projects inwardly from the side wall 2. Such short hinge pins 7 are exceedingly difficult to break or shear under the influence of a load. The encirclement of the pivot pins 7 by the U-shaped bearing eyes 8 assures a very strong hinge connection, the security of which is increased by providing on at least one of the legs of the bearing eye 8 a bead or cam portion 9 which forms a sort of snap connection by providing that the pivot pins 7 are embraced by the bearing eyes 8 through more than 180° so that once the bearing eyes 8 have snapped over the pivot pins 7 they cannot be separated without a very high external force.

As clearly seen in FIG. 7, the direction of the legs of the U-shaped bearing eyes 8 is perpendicular to the plane of the side wall 2. In the erected condition of the case as illustrated in FIG. 7, disengagement of the hinge is not possible because engagement of a corner portion of the side wall 1 formed as a holding shell 10 with reenforcing ribs 11 of the plate portion 25 and bearing eye 8 prevents movement of the side wall of the case by an outwardly directed inner force while an inwardly directed external force is absorbed by the pivot pins 7. Thus the hinge has a very high stability and assures also a very high stability of the corner connection.

For assembly of the case the individual parts of the case are laid flat on one another as they lie in that condition for the storage and transport of the empty case as illustrated in FIG. 6. Here the planes of the side walls 1 and 2 are not perpendicular to one another as they are illustrated in the erected condition shown in FIG. 7 but lie parallel to one another. This makes it possible to make the bearing eyes 8 snap over the pivot pin 7 simply by blow of a rubber hammer on the overlying side wall. Alternately, the parts can be pressed together by the action of a press. It will be understood that in order to separate the parts extra ordinarily high force must be exerted. Such separation of the parts can only be effected when the case is in collapsed condition as shown in FIG. 6.

In the special form shown in FIG. 10 which is a view corresponding to FIG. 9, the reenforcing ribs 11 are drawn over the bearing eye 8 so that they close the bearing eyes at the ends of the pivot pins 7. This brings about a further increase in the stability of the hinge. In this case it is necessary to provide cams 12 on the ends turned toward the case to make it possible to snap the parts together.

Figure 5:
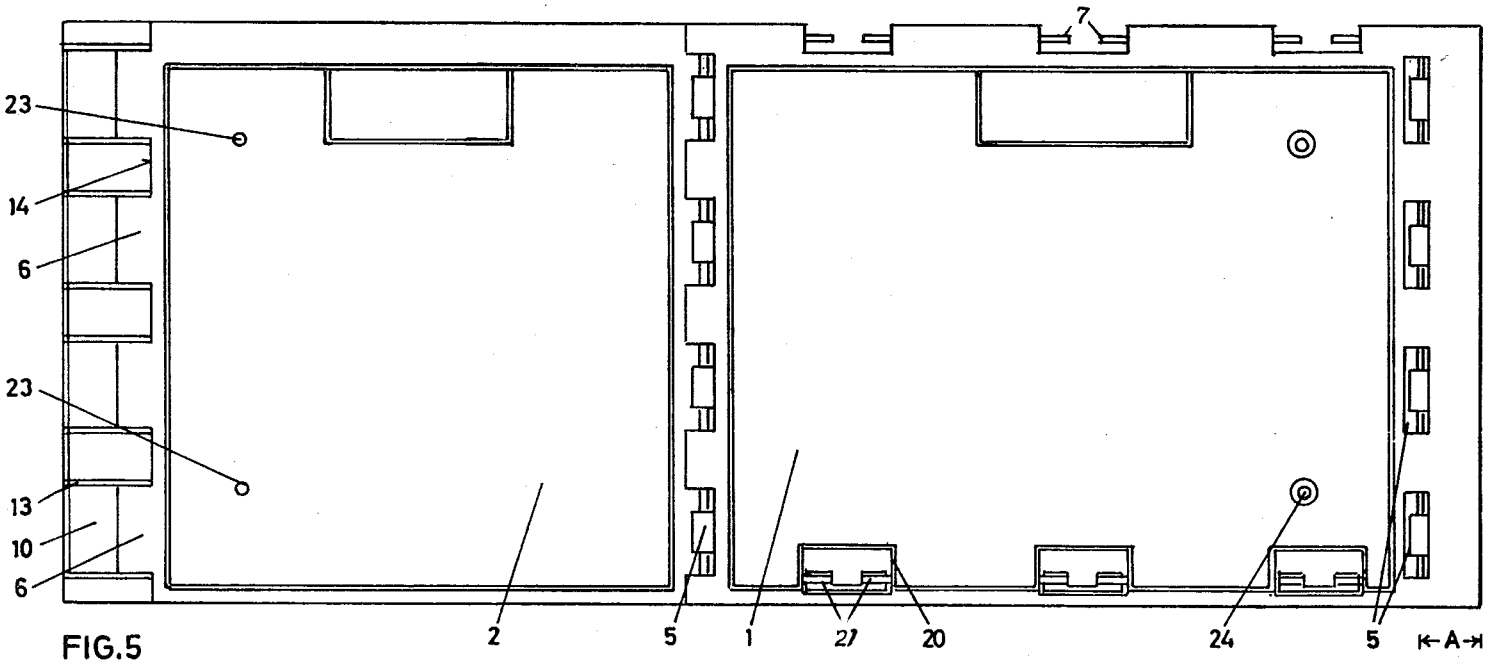
FIG. 5 is a side elevation of the collapsed transport case.

A side view of the collapsed case is shown in FIG. 5. The side wall 1 is seen at the right while at the far left there is seen the inner side of the corner of the side wall 1 that lies behind the side wall 2. There is here seen the holding shell portions 10 and the reenforcing ribs 13 between the portions 10. It is further seen that the left edge of the side wall 2 has cutouts 14 which are provided so that the reenforcing ribs 13 can extend to the edge of the side wall 1. Between two reenforcing ribs 13 adjacent the holding shell portion 10 there is shown the projection 6.

FIG. 11 is a cross section through the portions of the side walls 1 and 2 in the erected condition of the case. Here there is seen a corner portion 15 which is between and forms a continuation of the holding shell portions 10. On the edge of the corner portion 15 there is provided a bead 16 which snaps over a rib 17 on the adjacent side wall and thereby brings about a stabilization of the case against undesired collapse.

Figure 12:
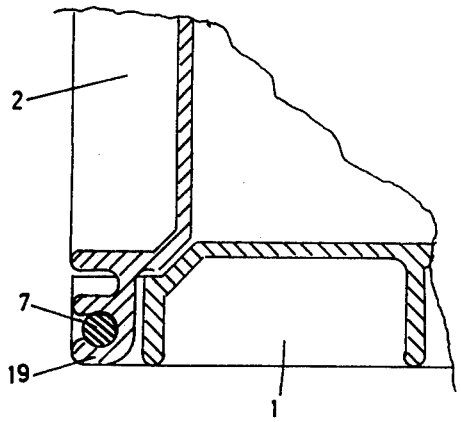
FIG. 12 is a cross section through another hinge.

In FIG. 12 there is shown a cross section of a hinge for connecting adjacent edges of side walls 1 and 2 at the location X as shown in FIG. 6. The hinge is shown in erected condition of the case. It will be seen that the hinge comprises pivot pins 7 on the side wall 1 and U-shaped bearing eyes 19 on side wall 2, one leg of the bearing eye being shown with an overhanging lip portion so that the bearing eye embraces the pivot pin 2 for more than 180°. It will be seen that a rib on the side wall 1 prevents disengagement of the bearing eye 19 from the pivot pin 7 when the case is in erected condition. As illustrated in FIG. 5, the bottom 3 is connected to the lower edge of one of the longer side walls 1 by hinges 27. Each of the hinges comprises a pair of opposed pivot pins on the side wall and a U-shaped bearing eye on the bottom. The hinges 27 are arranged in windows 20 in the side wall 1 which accommodate the bearing-carrying ribs in the collapsed condition of the case. When the case is in erected condition the bottom folds down and is supported by ledges 28 on the side wall. At one side the bottom has projections 21 which lie between the projections 6 in the collapsed condition of the case.

Figure 4:
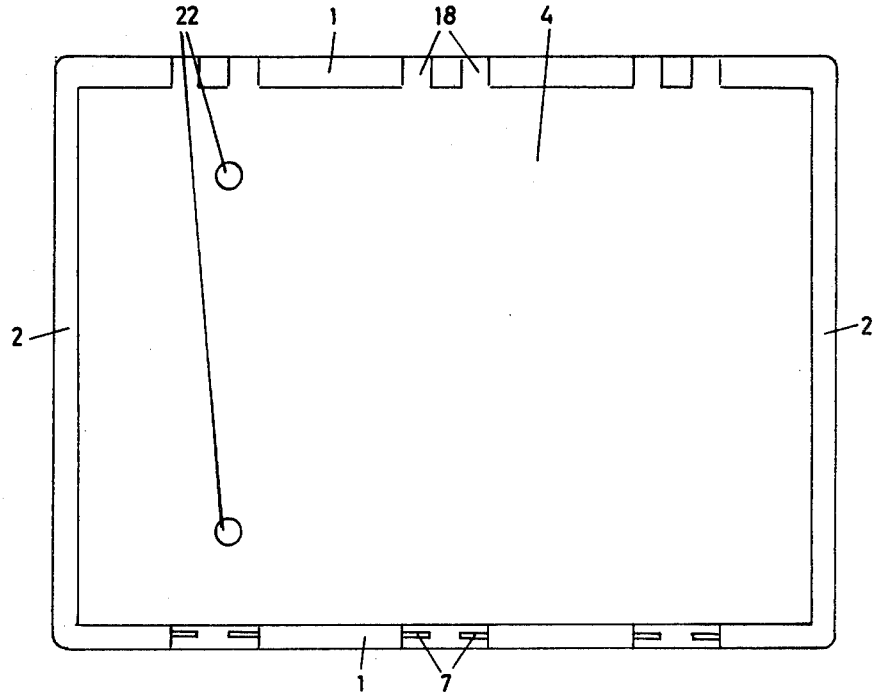
FIG. 4 is a plan view with the cover closed.
Figure 13:
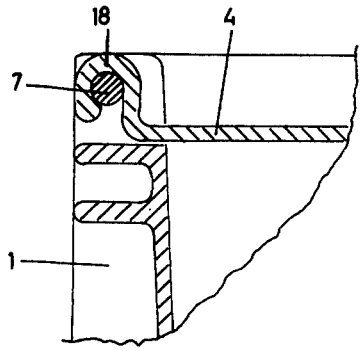
FIG. 13 is a cross section through a hinge for the cover.

In FIG. 13 there is shown in cross section one of the hinges for the cover 4. Each of the hinges comprises a pair of opposed pivot pins 7 at the upper edge of one of the longer side walls 1 (FIG. 4) and U-shaped bearing eyes 8 which snap onto the pivot pins.

The cover is provided with holes 22 through which centering elements 23 on the side wall 2 extend in the collapsed condition of the case and engage corresponding centering elements 24 on the outer side of the side walls 1 when a plurality of empty and collapsed cases are stacked on one another. These centering elements prevent the superposed cases from sliding relative to one another during storage or shipment.

While a preferred embodiment of the invention has been illustrated in the drawings and is herein particularly described, it will be understood that variations and modifications may be made and that the invention is hence in no way limited to the illustrated embodiment.

What is claimed is:

1. Collapsible and stackable plastic transport case comprising first and second pairs of like side walls, hinge means comprising a series of hinges hingedly connecting said side walls together at the corner of the case and a bottom hingedly connected with the lower edge of one of said side walls and foldable against the inner side of one side wall when said case is collapsed, each of the side walls of said first pair having one vertical edge hingedly connected by said hinge means with the adjacent vertical edge of a respective side wall of said second pair and having at the opposite vertical edge a connecting portion which projects inwardly a distance corresponding to the combined thickness of a side wall and the thickness of said bottom, said connecting portions being at diagonally opposite corners of said case and being connected by said hinge means with respective side walls of said second pair at a distance from the vertical edges thereof corresponding to the projection of said connecting portions to provide overhanging edge portions which extend beyond said hinge means and cover said connecting portions when the case is in set-up condition.

2. Transport case according to claim 1, in which said hinge means comprises pivot pins on one side wall and U-shaped bearing eyes on an adjacent side wall which receive said pins and embrace said pins slightly more than 180°, the opposite legs of said U-shaped bearing eyes being approximately perpendicular to the side wall on which said bearing eyes are provided.

3. Transport case according to claim 2, in which said connecting portions comprise plate portions which are reenforced by ribs and at the ends of which said bearing eyes are provided.

4. Transport case according to claim 3, in which said ribs merge into and are integral with both legs of said bearing eyes.

5. Transport case according to claim 4, in which at least one leg of each of said bearing eyes has a bead at its outer end.

6. Transport case according to claim 1, in which a cover is hingedly connected to the upper edge of one of said side walls and is swingable into a position lying on the outside of said side wall.

7. Transport case according to claim 1, in which centering elements on the side walls of the case are engageable with cooperating centering elements of a superposed case when empty and collapsed case are stacked to prevent said cases from slipping relative to one another.

* * * * *